US010637136B1

(12) United States Patent
Mui

(10) Patent No.: US 10,637,136 B1
(45) Date of Patent: Apr. 28, 2020

(54) FLEXIBLE ANTENNA ASSEMBLY

(71) Applicant: Mastodon Design LLC, Rochester, NY (US)

(72) Inventor: Andrew Mui, Rochester, NY (US)

(73) Assignee: Mastodon Design LLC, Rochester, NY (US)

( * ) Notice: Subject to any disclaimer, the term of this patent is extended or adjusted under 35 U.S.C. 154(b) by 0 days.

(21) Appl. No.: 16/566,154

(22) Filed: Sep. 10, 2019

Related U.S. Application Data

(62) Division of application No. 16/034,013, filed on Jul. 12, 2018, now Pat. No. 10,446,922.

(60) Provisional application No. 62/544,239, filed on Aug. 11, 2017.

(51) Int. Cl.

| | |
|---|---|
| ***H01Q 9/04*** | (2006.01) |
| ***H01Q 9/16*** | (2006.01) |
| ***H01Q 1/46*** | (2006.01) |
| ***H01Q 1/40*** | (2006.01) |

(52) U.S. Cl.
CPC ..... *H01Q 1/46* (2013.01); *H01Q 1/40* (2013.01); *H01Q 9/16* (2013.01)

(58) Field of Classification Search
CPC combination set(s) only.
See application file for complete search history.

(56) References Cited

U.S. PATENT DOCUMENTS 4,032,921 A * 6/1977 Sikina, Jr. ..... H01Q 9/27 343/730
4,352,109 A * 9/1982 Reynolds ..... H01Q 9/28 343/792
5,301,687 A * 4/1994 Wong ..... A61B 18/1815 606/33
5,928,145 A 7/1999 Ocali et al.
6,051,018 A * 4/2000 Larsen ..... A61B 18/18 607/101
6,229,495 B1 * 5/2001 Lopez ..... H01Q 9/32 343/702
2003/0107524 A1 * 6/2003 Hart ..... H01Q 21/24 343/860
2007/0233057 A1 10/2007 Konishi
(Continued)

*Primary Examiner* — Graham P Smith
*Assistant Examiner* — Jae K Kim
(74) *Attorney, Agent, or Firm* — Baker & Hostetler LLP

(57) ABSTRACT

The present application describes a method of forming a flexible dipole antenna. The method includes a step of surrounding an outer jacket of a cable with a lower limit radiating element. The lower limit radiating element includes a first annular surface opposite a second annular surface with a hollow body disposed therebetween joining the first and second annular surfaces together. Each of the first and second annular surfaces has a diameter greater than a diameter of the outer jacket of the cable. The method also includes a step of coupling the first annular surface of the lower limit radiating element with a metallic shield disposed within the outer jacket of the cable. The metallic shield encases an internal conductor of the cable. The method further includes a step of encasing the cable and the lower limit radiating element in a flexible outer sheath having a first end opposite a second end with a hollow body disposed therebetween joining the first and second ends together. The outer sheath has a diameter greater than a diameter of each of the first and second annular surfaces of the lower limit radiating element.

18 Claims, 8 Drawing Sheets

(56) References Cited

U.S. PATENT DOCUMENTS

| | | | | |
|---|---|---|---|---|
| 2012/0182196 | A1 | 7/2012 | Ngo Bui Hung | |
| 2012/0274529 | A1* | 11/2012 | Yoshino | H01Q 9/16 343/791 |
| 2013/0281036 | A1* | 10/2013 | Kolokotronis | H01Q 1/246 455/115.1 |
| 2015/0029059 | A1* | 1/2015 | Grossman | H01Q 1/243 343/702 |
| 2016/0087334 | A1* | 3/2016 | Sayama | H01Q 9/16 343/820 |

* cited by examiner

FLEXIBLE ANTENNA ASSEMBLY

CROSS-REFERENCE TO RELATED APPLICATIONS

This application is a divisional of U.S. patent application Ser. No. 16/034,013, filed Jul. 12, 2018, which claims the benefit of U.S. Provisional Patent Application No. 62/544,239, filed Aug. 11, 2017, all of which are incorporated by reference in their entirety.

BACKGROUND OF THE INVENTION

1. Field of the Invention

This invention relates, generally, to antennas. More specifically, it relates to a flexible broadband antenna assembly that improves over rigid antennas, as well as eliminates the need for adapters between a coaxial cable and a radio by integrating an antenna with a coaxial cable.

2. Brief Description of the Prior Art

Typical radio setups require an antenna coupled to a coaxial cable via a first adapter, with the coaxial cable couplable to a radio via a second adapter. Each of the adapters introduces additional loss in signal strength and stability. The signal losses caused by the adapters in turn reduce the battery life of the radio assembly, and decrease the range performance of the antenna. In addition, current coaxial cables do not include an antenna integrated therein, and instead include few components—an outer jacket, an internal metallic braid, insulating material, and a center conductor to transmit an electrical signal through an adapter to a radio. Traditional coaxial cables thereby rely on externally-coupled antennas, ultimately leading to signal loss between connections.

In addition, current antennas are typically rigid in order to receive high-strength signals, because the potential losses caused by the adapters necessitate high-quality signal strength to overcome the losses. Rigid antennas are useful when the antennas are designed to remain substantially stationary, such as permanently installed antennas for use in a home. However, for mobile applications, such as radio antennas used by law enforcement and military personnel, rigidity is less comfortable and less efficient. For example, a soldier in the field typically must carry a radio and a separately-mounted, rigid antenna, with the components being coupled via a coaxial cable. Such a configuration encumbers the wearer with additional weight and additional component parts, thereby forcing the wearer to carry awkwardly-connected pieces. For a military or law enforcement application, such encumbrances can lead to inefficient movement and greater visibility to enemies, which can ultimately endanger the safety of the wearer.

Accordingly, what is needed is a flexible combined antenna-and-coaxial-cable assembly that removes the need for adapters and separately-connected component parts. However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for a flexible combined antenna-and-coaxial-cable assembly is now met by a new, useful, and nonobvious invention.

The novel structure includes an antenna assembly including a coaxial cable, at least one radiating element, and a flexible outer sheath. The coaxial cable includes an outer jacket that surrounds a metallic shield, the shield surrounding an internal conductor, such that the outer jacket has an associated diameter greater than a diameter of the metallic shield, and the metallic shield has a diameter greater than a diameter of the internal conductor. A lower limit radiating element includes a first annular surface opposite a second annular surface, with a hollow body disposed therebetween joining the first and second annular surfaces together. The first and second annular surfaces include a diameter that is greater than the diameter of the outer jacket, such that the radiating element can surround at least a portion of the coaxial cable. The first annular surface of the lower limit radiating element couples with the metallic shield disposed within the outer jacket of the cable, thereby allowing a transfer of energy between the lower limit radiating element and the shield. Similarly, the flexible outer sheath includes a first end opposite a second end with a hollow body disposed therebetween joining the first and second ends together. The outer sheath includes a diameter that is substantially uniform along the hollow body, the diameter being greater than the diameter of the lower limit radiating element, allowing the outer sheath to surround the lower limit radiating element and the coaxial cable.

Each radiating element is adapted to receive and/or transmit radio signals of varying frequencies. In an embodiment, the radiating elements are metallic sheaths. Alternatively, the radiating elements may be copper braids. Regardless, the lower limit radiating element is adapted to form a dipole having a length between about ¼ and ½ of a wavelength of a lower limit operating frequency of a radio, such as a receiver or a transmitter to which the radiating element may be electrically coupled via an electrical connector, such as a RF connector. In an embodiment, the antenna assembly includes a second, higher limit radiating element having a length of less than ⅕ of the wavelength of the lower limit operating frequency. The lower limit and higher limit radiating elements are separated by an insulating layer, thereby preventing a short circuit.

The antenna assembly may include at least one magnetic element. The magnetic element has a diameter greater than the diameter of the outer jacket of the coaxial cable, thereby allowing the magnetic element to surround the coaxial cable. In an embodiment, the magnetic element is a ferrite having a relative magnetic permeability of approximately 125. The magnetic element is adapted to prevent external signals from interfering with those received or transmitted by the antenna assemblies, thereby operating as a common mode frequency choke.

The antenna assembly may be retrofitted onto an existing coaxial cable. To retrofit the antenna assembly, a portion of the outer jacket of the coaxial cable is removed, and the lower limit radiating element is cut such that it has a length equal to that of the removed portion of the coaxial cable. In an embodiment, the length is ⅖ of the wavelength of the lower limit operating frequency of the radio. After the lower limit radiating element is cut to size, at least a portion of the outer jacket of the coaxial cable is surrounded with the lower limit radiating element. A higher limit radiating element at least partially surround the lower limit radiating element, with the radiating elements being separated by an insulating layer. As discussed above, the higher limit radiating element has a length this is approximately 30% less than a length of the lower limit radiating element, allowing the higher limit radiating element to capture frequencies greater than those captured by the lower limit radiating element. The radiating elements and the coaxial cable are encased in a flexible outer sheath, thereby forming a flexible antenna assembly with an antenna integrated with an existing coaxial cable.

An object of the invention is to provide a flexible antenna assembly including an antenna integrally formed with a coaxial cable, combining radio components such that mobile applications are more efficient and comfortable by eliminating the need to transport a separately-connected antenna, and combining lower and higher limit radiating elements to capture a wide range of frequencies.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a combined antenna assembly integrally formed with a flexible coaxial cable, thereby removing the need for loss-inducing adapters between a radio and an antenna. In addition, the antenna assembly allows for the efficient and comfortable use of antennas for mobile applications, such as by law enforcement and military personnel in remote locations. While traditional antennas are rigid, the antenna assembly is flexible, thereby allowing a user to easily and simultaneously transport and use the antenna.

Figure 1:
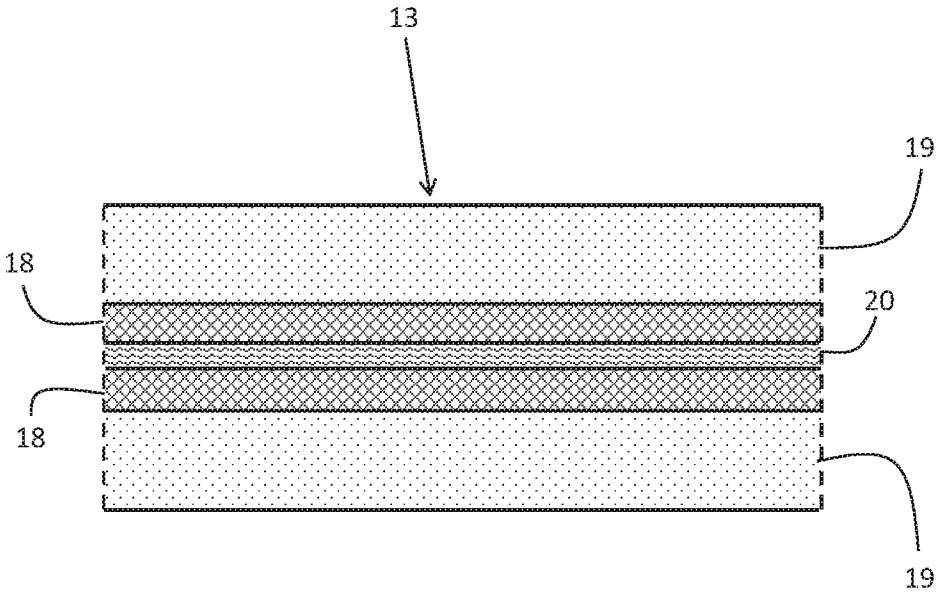
FIG. 1 is a cross-section orthogonal view of the interior components of a coaxial cable.

As shown in FIG. 1, a traditional coaxial cable 13 includes outer jacket 19 (depicted as reference numeral 19 in FIG. 3), typically made of PVC or other polymer, encasing internal metallic conductor 20, which is typically made of copper or silver. Internal conductor 20 is surrounded by an insulation layer that is disposed between the conductor and the jacket. Similar to outer jacket 19, the insulation layer is typically made of a natural or synthetic polymer; alternatively, the insulation layer could be made of a gel. The coaxial cable also includes metallic shield 18 (alternatively, shield 18 is commonly referred to as a sheath or a braid). Shield 18 surrounds internal conductor 20. In addition, other components may be present, such as additional aluminum shields to prevent signal interference.

Each component of coaxial cable 13 performs a function that is essential to the efficiency and efficacy of the cable. For example, outer jacket 19 encases the internal components, holding the components together in a relatively uniform shape. Internal conductor 20 transmits the cable's signal to an external electrical device, such as a television or radio. Metallic shield 18 prevents external signals from interfering with that of internal conductor 20 by intercepting the signals. To prevent a short circuit of the cable via a direct connection between internal conductor 20 and shield 18, coaxial cable 13 includes the insulation layer, which provides a spacer between internal conductor 20 and metallic shield 18.

The insulating layers included in traditional coaxial cables function to prevent the cable from acting as an antenna. This is because traditional coaxial cables are adapted to transmit electrical signals via internal conductor 20, relying on external antennae or other radio components to ultimately receive or transmit the signals used by a coaxial cable. As a result, typical coaxial cables electrically couple to adapters, allowing the cables to be used in signal receiving and transmitting functions via antennae. However, coupling the cable to adapters and external antennae leads to signal loss for each additional component, diminishing the signal quality transmitted by the coaxial cable. In addition, external components add to the bulk of the signal transmission assembly, making it difficult and inefficient for a user to transport and use each of the components.

Figure 2:
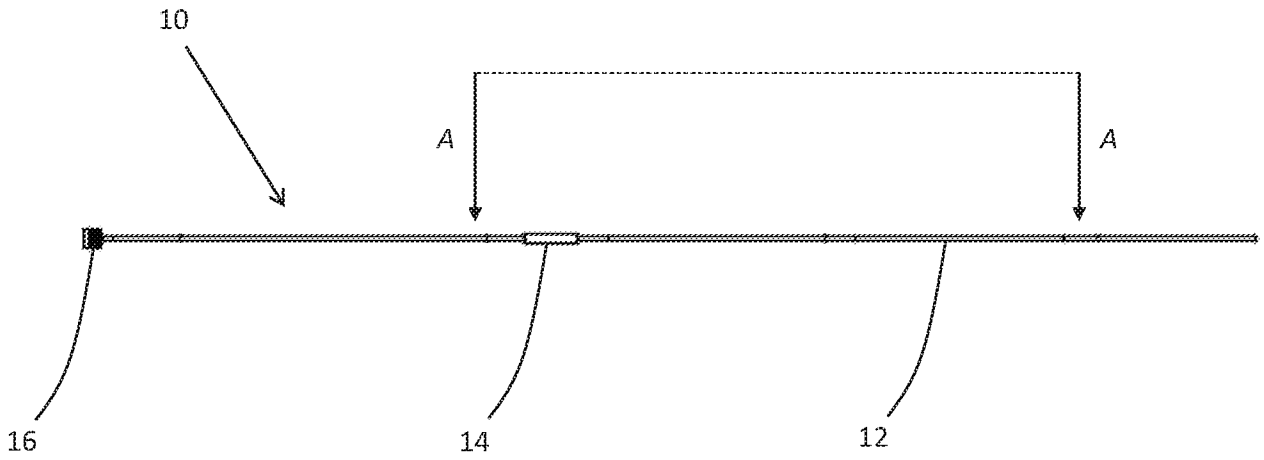
FIG. 2 is an orthogonal view of an exterior surface of a flexible broadband antenna assembly.

Accordingly, as shown in FIG. 2, an embodiment of antenna assembly 10 includes dipole assembly 12, magnetic element 14, and radio connector 16. Each of the components of antenna assembly 10 are in electrical communication with each other, allowing for electrical signals to be received and/or transmitted by antenna assembly 10. Specifically, the electrical signals are received and/or transmitted by dipole assembly 12, and are transmitted to coaxial cable 13 (shown in greater detail in FIGS. 4A and 4B) through an electric field that exists between dipole assembly 12 and coaxial cable 13. For example, if dipole assembly 12 receives electrical signals, the electrical signals are transmitted to coaxial cable 13 via the electric field between dipole assembly 12 and coaxial cable 13. The electrical signals are then transmitted via coaxial cable 13 to radio connector 16, such that the electrical signals can be broadcasted through an external radio. Conversely, if dipole assembly 12 transmits electrical signals, dipole assembly 12 receives the signals from radio connector 16 via coaxial cable 13 and the electrical field between coaxial cable 13 and dipole assembly 12. Magnetic element 14 is disposed between radio connector 16 and dipole assembly 12, such that magnetic element 14 prevents external signal noise from interfering with the electrical signals received and/or transmitted by antenna assembly 10. Antenna assembly 10 terminates in radio connector 16, which is adapted to mechanically couple with an external transmitter, such as a radio, to either send or receive electrical signals. Each of the components will be discussed individually below.

Figure 3A:
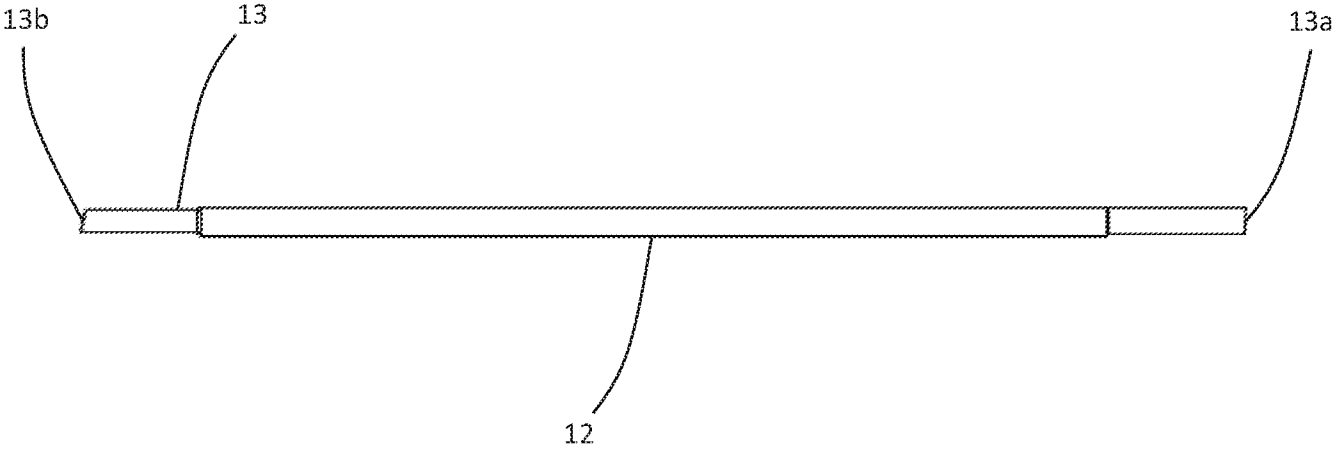
FIG. 3A is a close-up orthogonal view of a radiating element of the flexible broadband antenna assembly of FIG. 2.
Figure 3B:
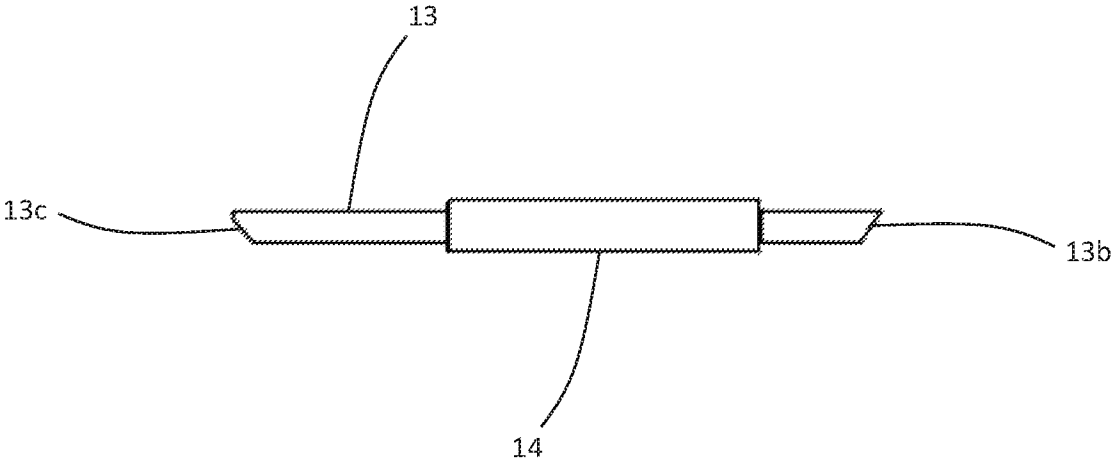
FIG. 3B is a close-up orthogonal view of a magnetic component of the flexible broadband antenna assembly of FIG. 2.
Figure 3C:
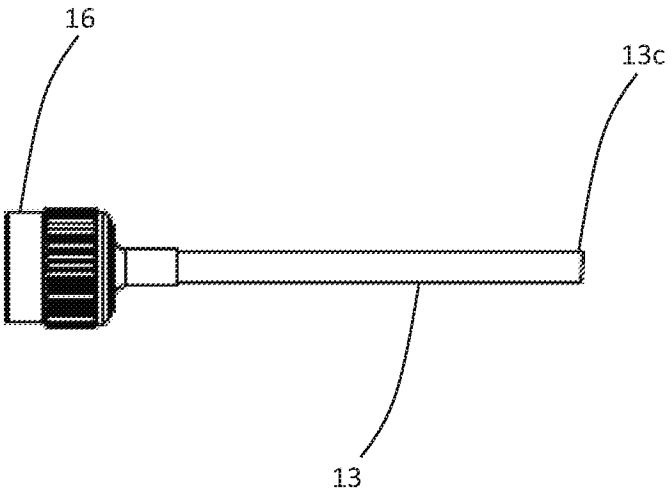
FIG. 3C is a close-up orthogonal view of an RF connector of the flexible broadband antenna assembly of FIG. 2.

FIGS. 3A-3C depict close-up views of the components of FIG. 2. For example, FIG. 3A depicts an exterior surface of dipole assembly 12, which is electrically coupled to coaxial cable 13 at sides 13*a*, 13*b*. The internal components of dipole assembly 12 will be discussed in greater detail below.

Magnetic element 14 is shown in greater detail in FIG. 3B, coupled to sides 13*b*, 13*c* of coaxial cable 13, and in electrical communication with dipole assembly 12 via side 13*b* of coaxial cable 13.

FIG. 3C shows radio connector 16 in greater detail. Radio connector 16 is electrically coupled to magnetic element 14 and in turn dipole assembly 12 via side 13*c* of coaxial cable 13. FIG. 3C also shows that radio connector 16 is a terminal coupling portion of antenna assembly 10, thereby providing a mechanism through which antenna assembly 10 can be connected to a radio device, which is adapted to communicate signals, allowing signals to be transmitted or received by antenna assembly 10 via the radio device.

Figure 4A:
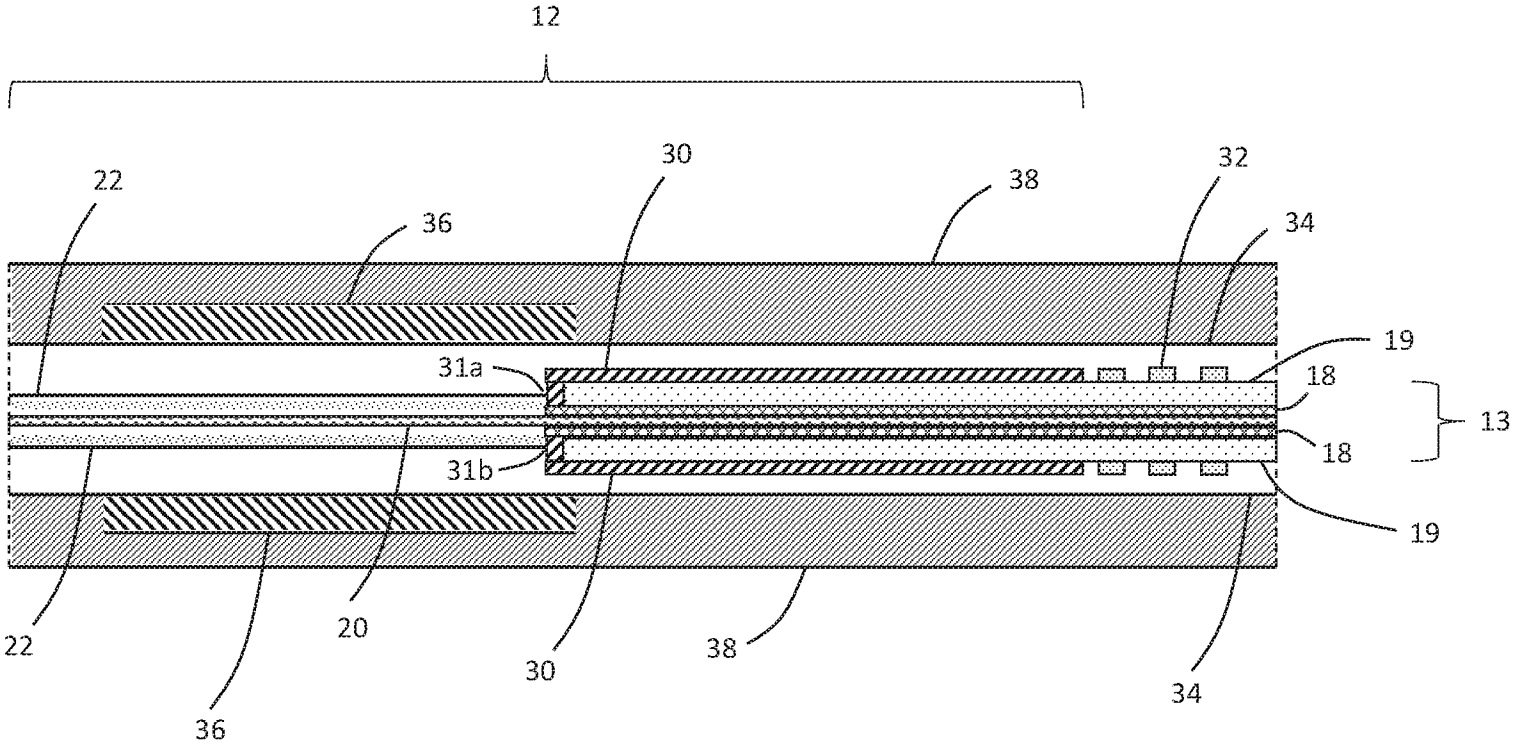
FIG. 4A is a cross-section orthogonal view of the interior components of the flexible broadband antenna assembly of FIG. 2, particularly the radiating element depicted in FIG. 3A.
Figure 4B:
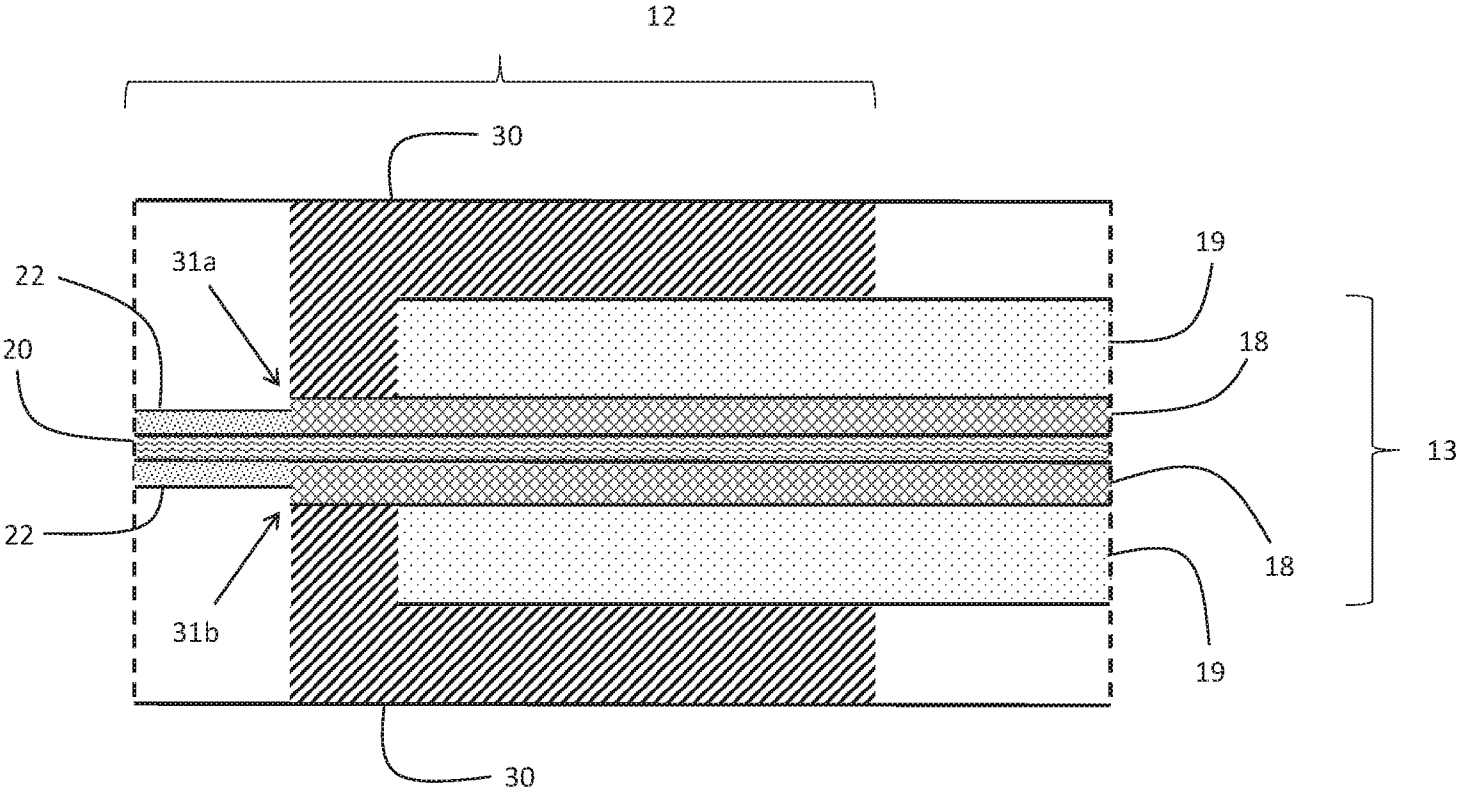
FIG. 4B is a close-up cross-section orthogonal view of the interior components of the flexible broadband antenna assembly of FIG. 4A, particularly showing the connection between the lower limit radiating element and the inner shield of the coaxial cable.

FIGS. 4A and 4B depict the internal components of dipole assembly 12, as well as the connection between dipole assembly 12 and coaxial cable 13, in greater detail. Dipole assembly 12 has a greater diameter than that of coaxial cable 13. Dipole assembly 12 is comprised of alternating conducting and insulating layers (i.e., insulating layers 22, 34 and outer jacket 38 are insulating layers; internal conductor 20, lower frequency radiating element 30, and higher frequency radiating element 36 are conducting layers), allowing dipole assembly 12 to function as the main antenna of antenna assembly 10 while surrounding coaxial cable 13. As discussed above, typical coaxial cables include at least an outer jacket 19, a shield 18, and an internal conductor 20—as shown in FIG. 4A-4B, internal conductor 20 has a diameter less than outer jacket 19 of coaxial cable 13. In the embodiment of FIG. 4A, internal conductor 20 extends away from coaxial cable 13, which has been altered to accommodate for dipole assembly 12. The alteration of coaxial cable 13 will be discussed in greater detail below. Internal conductor 20 is surrounded by insulation layer 22, which may be a heat shrink material that is designed to wrap around internal conductor 20 upon being subjected to high temperatures.

Outer jacket 19 of coaxial cable 13 is at least partially encased within lower frequency radiating element 30, which may be a metallic sheath or braid, such as a copper sheath or braid. A diameter of lower frequency radiating element 30 is greater than that of outer jacket 19 of coaxial cable 13, thereby allowing lower frequency radiating element 30 to surround and encase at least a portion of coaxial cable 13. Lower frequency radiating element 30 is largely cylindrical in shape, having one open end, allowing the radiating element to slide over coaxial cable 13. The opposite end of lower frequency radiating element 30 electrically couples with shield 18 of coaxial cable 13 via contacts 31*a* and 31*b*. Contacts 31*a*, 31*b* may be formed via common methods of forming an electrical connection, such as via soldering the radiating element to the shield. Contacts 31*a*, 31*b* allow the transfer of energy from coaxial cable 13 to lower frequency radiating element 30, and vice versa. As such, lower frequency radiating element 30 encases coaxial cable 13 while allowing electrical signals to travel along internal conductor 20.

Lower frequency radiating element 30 functions as the main antenna of dipole assembly 12. To bring in high-quality broadband signals, lower frequency radiating element 30 forms a dipole having a length between about ¼ and ⅐ of a wavelength of a lower limit operating frequency, and preferably forms a dipole having a length of ⅖ of the wavelength of the lower limit frequency to produce the largest bandwidth. The length of the dipole may vary depending on the desired frequencies of a particular application, but can be found using the formula:

$$l = \frac{2}{5}\lambda,$$

where l represents the length of the dipole, and represents the desired wavelength as determined by the formula:

$$\lambda = \frac{c}{f}$$

where c/f is the ratio of the speed of light to the desired frequency, the frequency being the lower limit operating frequency that will yield the longest wavelength and, thereby, the longest dipole length. For example, if the lower limit operating frequency is 50 MHz, the dipole length is 2.4 m, following the above formula. Similarly, if the lower limit operating frequency is 1000 MHz, the dipole length is 0.12 m. As such, depending on the desired lower limit operating frequency, antennas of varying lengths can be used based on the length of the dipole needed to transmit at the lower frequency.

As shown in FIG. 4A, one or more frequency chokes 32 at least partially surround outer jacket 19 of coaxial cable 13. Frequency chokes 32, similar to lower frequency radiating element 30, have a diameter greater than that of coaxial cable 13, allowing frequency chokes 32 to partially encase coaxial cable 13. Frequency chokes 32 function as electronic chokes to prevent interfering current from flowing along coaxial cable 13 to dipole assembly 12, thereby preventing signal interference. In a preferred embodiment, three or more frequency chokes 32 are used, as shown in FIG. 4A, and frequency chokes 32 are common-mode chokes in order to suppress electromagnetic signals, as well as radio frequency signals. By reducing electromagnetic and radio frequency interferences, frequency chokes 32 function to reduce signal noise. Frequency chokes 32 may be made of a variety of materials commonly used within the art, but in a preferred embodiment, frequency chokes 32 are ferrites, such as nickel zinc ferrites, having about 125 relative permeability. Relative permeability dictates the ability of a material to form a magnetic field, which thereby prevents interference from other magnetic fields. Using ferrites having relative permeability of about 125 allows antenna assembly 10 to be used to transmit and receive signals from low Very High Frequency (VHF) bands (between 30 MHz and 300 MHz) to Ultra High Frequency (UHF) bands (between 300 MHz and 3 GHz).

Insulation layer 34 encases coaxial cable 13, including internal conductor 20 and insulation layer 22, as well as lower frequency radiating element 30 and frequency chokes 32. As such, insulation layer 34 acts as a first insulating barrier between the dipole formed by lower frequency radiating element 30 and subsequent electromagnetic components of antenna assembly 10. Insulation layer 34 may be PVC, or may be a heat shrink material designed to conform to the shape of the aforementioned components, providing a singular and flexible cable including an antenna.

Still referring to FIG. 4A, higher frequency radiating element 36 partially surrounds insulation layer 34. Higher frequency radiating element 36 is a second dipole sheath. Similar to lower frequency radiating element 30, higher frequency radiating element 36 may be a metallic sheath or braid, such as a copper sheath or braid. Whereas lower frequency radiating element 30 forms the dipole for the lower limit operating frequency, higher frequency radiating element 36 forms the dipole for the upper limit operating frequency. As such, higher frequency radiating element 36 has a length that is approximately 30% shorter than that of lower frequency radiating element 30, allowing higher frequency radiating element 36 to capture higher frequencies than lower frequency radiating element 30. While it is appreciated that the 30% shorter length of higher frequency radiating element 36 was found to produce the optimal bandwidth range within antenna assembly 10, it is appreciated that the ratio between the lengths of higher frequency radiating element 36 and lower frequency radiating element 30 could be greater than or less than 30%. Similar to lower frequency radiating element 30 discussed above, higher frequency radiating element 36 is cylindrical in shape, having two opposing open ends, thereby allowing higher frequency radiating element 36 to encase insulation layer 34 without interfering with lower frequency radiating element 30.

Outer jacket 38 encases all of the internal components of dipole assembly 12, including coaxial cable 13, lower frequency radiating element 30, higher frequency radiating element 36, frequency chokes 32, and insulation layers 22 and 34. Outer jacket 38 is made of similar materials as insulation layers 22 and 34, as well as outer jacket 19 of coaxial cable 13. For example, outer jacket 38 may be made of PVC, or may be made of a heat shrink material. The purpose of outer jacket 38 is to provide an outer casing for the internal components of dipole assembly 12, as well as antenna assembly 10, allowing dipole assembly 12 to be flexible as well as insulated from exterior signals, and antenna assembly 10 to be largely noise-free when transmitting or broadcasting electrical signals. The flexibility of outer jacket 38, as well as the internal components of dipole assembly 12, allows antenna assembly 10 to be transported for remote applications without the need for bulky and rigid equipment, such as rigid external antennas.

Figure 5:
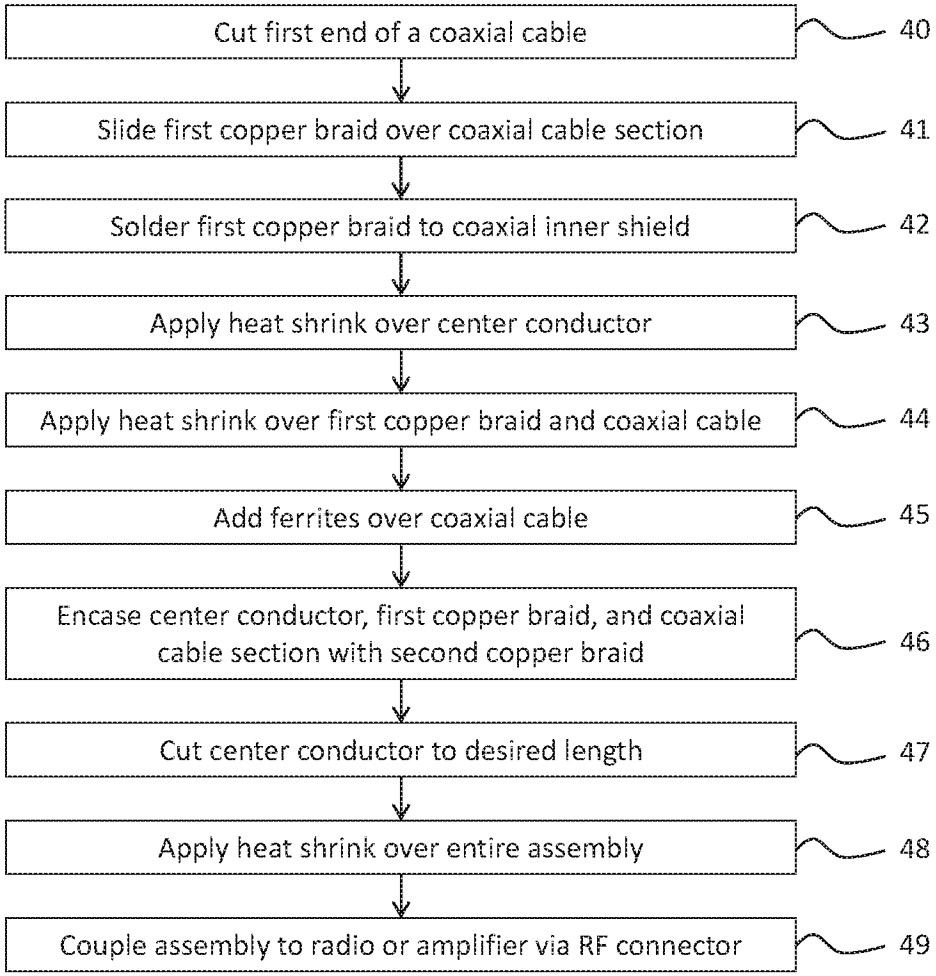
FIG. 5 is a process flow diagram of a method of manufacturing a flexible broadband antenna assembly.

Antenna assembly 10 can be formed together with coaxial cable 13, or can be retrofit onto an existing coaxial cable 13 through a series of steps. Regardless of the method of manufacture, the process of forming a dipole antenna, such as antenna assembly 10, is largely identical. Accordingly, referring now to FIG. 5, in conjunction with FIGS. 1-4B, an exemplary process-flow diagram is provided, depicting a method of forming a dipole antenna assembly. The steps delineated in the exemplary process-flow diagram of FIG. 5 are merely exemplary of a preferred order of forming a dipole antenna assembly. The steps may be carried out in another order, with or without additional steps included therein.

First, during step 40, outer jacket 19 of coaxial cable 13 is cut to expose the metallic sheath immediately underneath. The cut is made such that the length of the metallic sheath that is exposed measures approximately ⅕ of a wavelength of a lower limit operating frequency. The exposed length of metallic sheath is then removed from coaxial cable 13, and a new lower frequency radiating element 30 is cut to be the same length as the removed, exposed metallic sheath from the original coaxial cable 13. While the removed metallic sheath was housed within coaxial cable 13, thereby inherently having a diameter smaller than that of coaxial cable 13, new lower frequency radiating element 30 has a diameter slightly greater than that of coaxial cable 13. The difference in diameters allows lower frequency radiating element 30 to at least partially surround coaxial cable 13, and lower frequency radiating element 30 may be slid over coaxial cable 13 in step 41, as depicted in FIG. 4A. Lower frequency radiating element 30 couples with shield 18 on coaxial cable 13 in step 42, during which the radiating element is soldered to shield 18, thereby providing for the transfer of energy between coaxial cable 13 and lower frequency radiating element 30.

The removal of the metallic sheath of coaxial cable 13 exposes internal conductor 20, which could cause interference and/or a short circuit between internal conductor 20 and lower frequency radiating element 30. As such, it is important to insulate internal conductor 20 during step 43, thereby providing insulation layer 22 between internal conductor 20 and lower frequency radiating element 30. Insulation layer 22 may be formed via a heat shrink material, such as by wrapping internal conductor 20 in a heat shrink material, and subsequently exposing the heat shrink material to a high temperature. The high temperature reduces the diameter of the insulation layer 22, until insulation layer 22 conforms to the shape of internal conductor 20. Similarly, during step 44, coaxial cable 13 and lower frequency radiating element 30 are encased within insulation layer 34.

To reduce signal interference from external electrical currents, a plurality of frequency chokes 32 are installed over coaxial cable 13 during step 45. In a preferred embodiment, and as shown in FIG. 4A, at least three frequency chokes 32 are used. Frequency chokes 32 are preferably ferrites, such as nickel zinc ferrites. After installing frequency chokes 32 on coaxial cable 13 and upstream from lower frequency radiating element 30, which is the main antenna of antenna assembly 10, the internal components are encased in another insulation layer 34.

During step 46, the insulated coaxial cable 13 and dipole assembly 12 are then further partially encased in higher frequency radiating element 36, which is similar to lower frequency radiating element 30, except in length—higher frequency radiating element 36 is shorter than lower frequency radiating element 30 by approximately 30%. Insulation layer 34 provides a barrier between the most interior components of dipole assembly 12 and higher frequency radiating element 36, thereby reducing noise and preventing signal interference.

Internal conductor 20 is cut to a desired length based on the application of antenna assembly 10 during step 47. In step 48, once the desired length is selected, outer jacket 38 encases the internal components of antenna assembly 10, including higher frequency radiating element 36, as well as the components housed within insulation layer 34 but not encased by higher frequency radiating element 36. Outer jacket 38, as well as insulation layers 34 and 22, is made of a flexible material, such as PVC or heat shrink material, allowing the entirety of antenna assembly 10 to be flexible and easily transported for mobile uses. Finally, during step 49, antenna assembly 10 electrically couples with a radio, amplifier, or other transmitter via radio connector 16.

Glossary of Claim Terms

Annular surface: is an end of a hollow cylinder.

Bandwidth: is a frequency range over which an antenna assembly can operate.

Dipole: is an electrical conductor connected to a radio-frequency feed line, with the dipole having an associated length dictated by a desired lower limit operating frequency.

Flexible: capable of deforming without breaking.

Magnetic element: is an inductor that intercepts interfering signals from passing therethrough to a radiating element.

Operating frequency: is a desired frequency broadcasted or received by an antenna assembly. For example, a lower limit operating frequency is the lowest frequency that can be received or transmitted by the antenna. Similarly, a higher limit operating frequency is the highest frequency that can be received or transmitted by the antenna.

Radiating element: is a component of an antenna assembly that is capable of receiving or transmitting radio-frequency energy.

Sheath: is a close-fitting protective covering having a diameter greater than a diameter of the structure that is encased by the sheath.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

What is claimed is:

1. A method of forming a flexible dipole antenna comprising:

surrounding an outer jacket of a cable with a lower limit radiating element, the lower limit radiating element including a first annular surface opposite a second annular surface with a hollow body disposed therebetween joining the first and second annular surfaces together, each of the first and second annular surfaces having a diameter greater than a diameter of the outer jacket of the cable;

coupling the first annular surface of the lower limit radiating element with a metallic shield disposed within the outer jacket of the cable, the metallic shield encasing an internal conductor of the cable; and encasing the cable and the lower limit radiating element in a flexible outer sheath having a first end opposite a second end with a hollow body disposed therebetween joining the first and the second ends together, the flexible outer sheath having a diameter that is greater than the diameter of each of the first and second annular surfaces of the lower limit radiating element; and extending a bandwidth of the flexible dipole antenna by indirectly surrounding the lower limit radiating element with a higher limit radiating element, the higher limit radiating element having a length that is approximately 30% less than a length of the lower limit radiating element, allowing the higher limit radiating element to capture frequencies greater than those captured by the lower limit radiating element.

2. The method of claim 1, further comprising:

cutting the lower limit radiating element such that the hollow body has a length that is ⅖ of a wavelength of a lower limit operating frequency.

3. The method of claim 1, further comprising:

surrounding the lower limit radiating element with an insulating layer prior to encasing the cable and the lower limit radiating element in the flexible outer sheath.

4. The method of claim 3, further comprising:

surrounding the insulating layer with a higher limit radiating element, the higher limit radiating element including a first annular surface opposite a second annular surface with a hollow body disposed therebetween joining the first and second annular surfaces together, each of the first and second annular surfaces having a diameter greater than the diameter of the lower limit radiating element.

5. The method of claim 1, further comprising:

surrounding the outer jacket of the cable with at least one magnetic element having a diameter greater than the diameter of the outer jacket, the at least one magnetic element having a relative magnetic permeability of approximately 125.

6. The method of claim 1, further comprising:

attaching an electrical connector to one of the first and the second ends of the flexible outer sheath, the electrical connector adapted to form a connection between the lower limit radiating element and a signal receiver or transmitter.

7. The method of claim 1, wherein the flexible outer sheath continuously encases the cable and the lower limit radiating element.

8. The method of claim 1, wherein the lower limit radiating element is flexible.

9. The method of claim 8, wherein the lower limit radiating element is electrically coupled to a dipole via an electric field.

10. The method of claim 9, wherein the dipole has a length ranging from ¼ and ½ wavelength of a lower operating frequency.

11. The method of claim 1, wherein the lower limit radiating element is electrically coupled to at least one of a receiver and transmitter.

12. The method of claim 1, wherein the lower limit radiating element is a metallic sheath.

13. The method of claim 4, wherein the higher limit radiating element is flexible.

14. A method of retrofitting a dipole antenna onto a coaxial cable comprising: removing a portion of an outer jacket of a coaxial cable;

surrounding the outer jacket of the coaxial cable with a lower limit radiating element, the lower limit radiating element including a first annular surface opposite a second annular surface with a hollow body disposed therebetween joining the first and second annular surfaces together, each of the first and second annular surfaces having a diameter greater than a diameter of the outer jacket of the coaxial cable;

coupling the first annular surface of the lower limit radiating element with a metallic shield disposed within the outer jacket of the coaxial cable, the metallic shield encasing an internal conductor of the coaxial cable; and encasing the coaxial cable and the lower limit radiating element in a flexible outer sheath having a first end opposite a second end with a hollow body disposed therebetween joining the first and second ends together, the flexible outer sheath having a diameter that is greater than the diameter of each of the first and second annular surfaces of the lower limit radiating element; and extending a bandwidth of the dipole antenna by cutting the higher limit radiating element such that it has a length that is approximately 30% less than a length of the lower limit radiating element, allowing the higher limit radiating element to capture frequencies greater than those captured by the lower limit radiating element.

15. The method of claim 14, further comprising:

cutting the lower limit radiating element such that the hollow body has a length equal to a length of the removed portion of the outer jacket of the coaxial cable.

16. The method of claim 14, further comprising:

cutting the lower limit radiating element such that the hollow body has a length that is ⅖ of a wavelength of a lower limit operating frequency prior to surrounding the outer jacket of the coaxial cable with the lower limit radiating element.

17. The method of claim 14, further comprising:

surrounding the lower limit radiating element with an insulating layer prior to encasing the coaxial cable and the lower limit radiating element in the flexible outer sheath; and surrounding the insulating layer with a higher limit radiating element, the higher limit radiating element including a first annular surface opposite a second annular surface with a hollow body disposed therebetween joining the first and second annular surfaces together, each of the first and second annular surfaces having a diameter greater than the diameter of the lower limit radiating element.

18. The method of claim 14, wherein the lower limit radiating element is flexible, the lower limit radiating element is electrically coupled to a dipole via an electric field, and the dipole has a length ranging from ¼ and ½ wavelength of a lower operating frequency.

* * * * *